US007703651B2

(12) United States Patent
Yamamoto et al.

(10) Patent No.: US 7,703,651 B2
(45) Date of Patent: Apr. 27, 2010

(54) DRIVING TOOL

(75) Inventors: Hiroki Yamamoto, Tokyo (JP); Tatsushi Ogawa, Tokyo (JP); Yasunori Aihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 142 days.

(21) Appl. No.: 11/996,104

(22) PCT Filed: Jul. 20, 2006

(86) PCT No.: PCT/JP2006/314339

§ 371 (c)(1),
(2), (4) Date: Jan. 18, 2008

(87) PCT Pub. No.: WO2007/010959

PCT Pub. Date: Jan. 25, 2007

(65) Prior Publication Data

US 2009/0230166 A1 Sep. 17, 2009

(30) Foreign Application Priority Data

Jul. 20, 2005 (JP) ..... 2005-210495

(51) Int. Cl.
*B25C 1/04* (2006.01)

(52) U.S. Cl. ..... 227/130; 227/139

(58) Field of Classification Search ..... 227/120, 227/129, 130, 139
See application file for complete search history.

(56) References Cited

U.S. PATENT DOCUMENTS 3,010,430 A 11/1961 Allen et al.
3,288,339 A * 11/1966 Bade ..... 227/130
3,871,405 A 3/1975 Schwarz
4,480,528 A * 11/1984 Shiroyama ..... 91/461
4,581,964 A * 4/1986 Takatsuru ..... 81/464
5,131,579 A * 7/1992 Okushima et al. ..... 227/8
5,181,450 A * 1/1993 Monacelli ..... 91/41
5,207,143 A * 5/1993 Monacelli ..... 91/442
5,217,153 A 6/1993 Yamamoto et al.
5,259,465 A * 11/1993 Mukoyama ..... 173/168
5,476,205 A * 12/1995 Canlas et al. ..... 227/130
5,485,946 A * 1/1996 Jankel ..... 227/8

(Continued)

FOREIGN PATENT DOCUMENTS

DE 42 13 310 A1 10/1993
DE 201 08 469 U1 10/2001
JP 54-164067 12/1979
JP 58-8457 2/1983
JP 5-2877 1/1993
JP 5-16158 3/1993
JP 6-45336 11/1994

*Primary Examiner*—Paul R Durand
(74) *Attorney, Agent, or Firm*—Drinker Biddle & Reath LLP

(57) ABSTRACT

A striking cylinder 6 is disposed within a body 1. A main air chamber 7 for reserving compressed air therein is disposed at an outside of the striking cylinder 6. A cylinder cap 8 for covering the striking cylinder 6 and the main air chamber 7 is fixed at an upper portion of the body 1. A lower portion of a cylindrical head valve 13, which opens and closes the main air chamber 7 and the striking cylinder 6 and is configured in a manner that upper and lower external diameters thereof are the same, is disposed at an outside of the striking cylinder 6. A cylindrical inner wall 10 and a cylindrical outer wall 11 are integrally formed at a lower surface of the cylinder cap 8. A piston stop 12 for defining a top dead center of a striking piston 5 is provided at an inside of the cylindrical inner wall 10. The head valve 13 is slidably provided between the cylindrical inner wall 10 and the cylindrical outer wall 11.

3 Claims, 4 Drawing Sheets

U.S. PATENT DOCUMENTS 5,873,510 A * 2/1999 Hirai et al. ..... 227/130
5,878,936 A * 3/1999 Adachi et al. ..... 227/130
6,006,975 A * 12/1999 Ishizawa ..... 227/119
6,041,992 A * 3/2000 Poinelli et al. ..... 227/130
6,533,156 B1 * 3/2003 Chang ..... 227/130
6,648,202 B2 * 11/2003 Miller et al. ..... 227/130
6,834,789 B1 12/2004 Dion et al.
7,448,524 B1 * 11/2008 Liang et al. ..... 227/130
7,451,903 B2 * 11/2008 Aihara ..... 227/130
7,490,748 B2 * 2/2009 Komazaki ..... 227/130
7,556,183 B1 * 7/2009 Liang et al. ..... 227/130
2004/0011846 A1 1/2004 Aoki et al.

* cited by examiner

DRIVING TOOL

TECHNICAL FIELD

The present invention relates to a low entire-height structure of a driving tool which can lower an entire height of the tool.

BACKGROUND ART

In general, a main air chamber for reserving compressed air is disposed within a body of a driving tool such as a nail driving machine or a screw driving machine. The main air chamber is connected to a grip. An introducing inlet connected to a compressed-air supply source is formed at a rear end of the grip. Further, at an inside of the main air chamber, there is disposed a striking cylinder which accommodates a striking piston coupled with a driver for driving a nail so as to be slidable freely. Furthermore, a head valve is provided at an upper portion of the striking cylinder. In the case where the head valve is arranged to be opened/closed with respect to the main air chamber, when the valve is opened, the compressed air within the main air chamber is supplied to the striking cylinder thereby to drive the striking piston and the driver, whereby a nail is struck and driven. After the driving, the head valve is closed to make the upper portion of the striking cylinder communicate with an exhaust path thereby to exhaust the compressed air supplied to the striking cylinder.

The driving tool would be smaller in its weight and easier in handling if the entire height thereof is lower. When the entire height of the driving tool is low, an usability of the tool is good in the case of using the tool between intermediate posts in the conventional construction method or between studs in the two-by-four method. Thus, demands for the body of the low entire height is great in such usages.

Members such as the striking cylinder, the head valve of a cylindrical shape are provided within the body. The height of the striking cylinder can not be made low since the height relates to the output of the tool. Thus, it is required to invent the position of the head valve and the structure for exhausting.

Conventionally, the head valve is disposed at the upper portion of the striking cylinder, then a cylinder cap is provided above the head valve and an exhaust cover is disposed above the cap. Thus, firstly, there has been though of a structure of exhausting to the side direction. In this case, the entire height can be made low since the exhaust cover at the upper portion is eliminated. Further, there has been though of another structure in which the head valve is disposed at the outside of the striking cylinder, as disclosed in JP-Y-06-045336. In this case, since a ratio of the height of the head valve with respect to the entire height of the body is made lower, the entire height can be further lower when combined with the aforesaid improvement of the exhausting structure.

However, according to the structure of disposing the head valve at the outside of the striking cylinder, the lower portion of the head valve is fit deeply at the outside of the striking cylinder. Thus, the top dead center of the striking piston is required to be set to a position lower than the upper end of the striking cylinder, and so the height above the striking piston is not so suppressed. Further, since the height of the head valve is lowered, it becomes necessary to provide a member for guiding and opening/closing the head valve, particularly, the lower portion thereof. Thus, to this end, conventionally another member is disposed at the inner and outer peripheries of the head valve so that another member guides the inner and outer peripheries of the head valve. Accordingly, the number of parts becomes large, which results in the increase of the weight and the cost.

An object of the invention is to provide a low entire-height structure which can reduce the number of parts to realize the low entire-height and also can reduce a cost.

DISCLOSURE OF THE INVENTION

According to one or more embodiments of the invention, a striking tool is provided with a striking cylinder which is disposed within a hollow body and accommodates a striking piston coupled with a nail driving driver so as to be slidable freely, a main air chamber which is disposed at the outside of the striking cylinder and reserves compressed air therein, a cylinder cap which is fixed at the upper portion of the body and covers the striking cylinder and the main air chamber, and a head valve which opens and closes the main air chamber and the striking cylinder and is formed in a cylindrical shape so as to have same upper and lower external diameters. The lower portion of the head valve is disposed at the outside of the striking cylinder. A cylindrical inner wall and a cylindrical outerwall are integrally formed at the lower surface of the cylinder cap. A piston stop defining the top dead center of the striking piston is provided at the inside of the cylindrical inner wall. The head valve is disposed between the cylindrical inner wall and the cylindrical outer wall so as to be slidable freely.

Further, an exhaust port may be formed at each of the lower portion of the side wall of the cylinder cap and the head valve so as to penetrate therethrough. When the head valve closes, the exhaust port of the cylinder cap communicates with the upper portion of the striking cylinder via the exhaust port of the head valve.

Further, an exhaust cover may be disposed at the outside of the exhaust port at the side wall of the cylinder cap and exhaust gas may be exhausted from an exhaust port formed at the lower portion of the exhaust cover via a filter.

According to the aforesaid driving tool, since the lower portion of the head valve is disposed at the outside of the striking cylinder and the head valve is provided so as to be slidable freely between the cylindrical inner wall and the cylindrical outer wall formed at the lower surface of the cylinder cap, it is not necessary to provide a special head valve guide like the related art. Thus, the low entire-height can be realized, the number of parts can be reduced and the configuration can be simplified, whereby the cost can be also reduced.

Further, in the case where the head valve is closed after the completion of the driving operation, when the exhaust port of the cylinder cap communicates with the upper portion of the striking cylinder via the exhaust port of the head valve, the compressed air within the striking cylinder is exhausted from the exhaust port at the side wall of the cylinder cap. Thus, the entire height of the driving tool can be made low.

Furthermore, in the case of exhausting from the exhaust port formed at the lower portion of the exhaust cover via the filter, the filter can be disposed and fixed between the side wall of the cylinder cap and the exhaust cover. Thus, only the exhaust cover may be required to be fixed to the cylinder cap by means of bolts. Thus, the number of bolts can also be reduced.

Other aspects and advantages of the invention will be apparent from the following description and the appended claims.

REFERENCE NUMERALS

Figure 1:
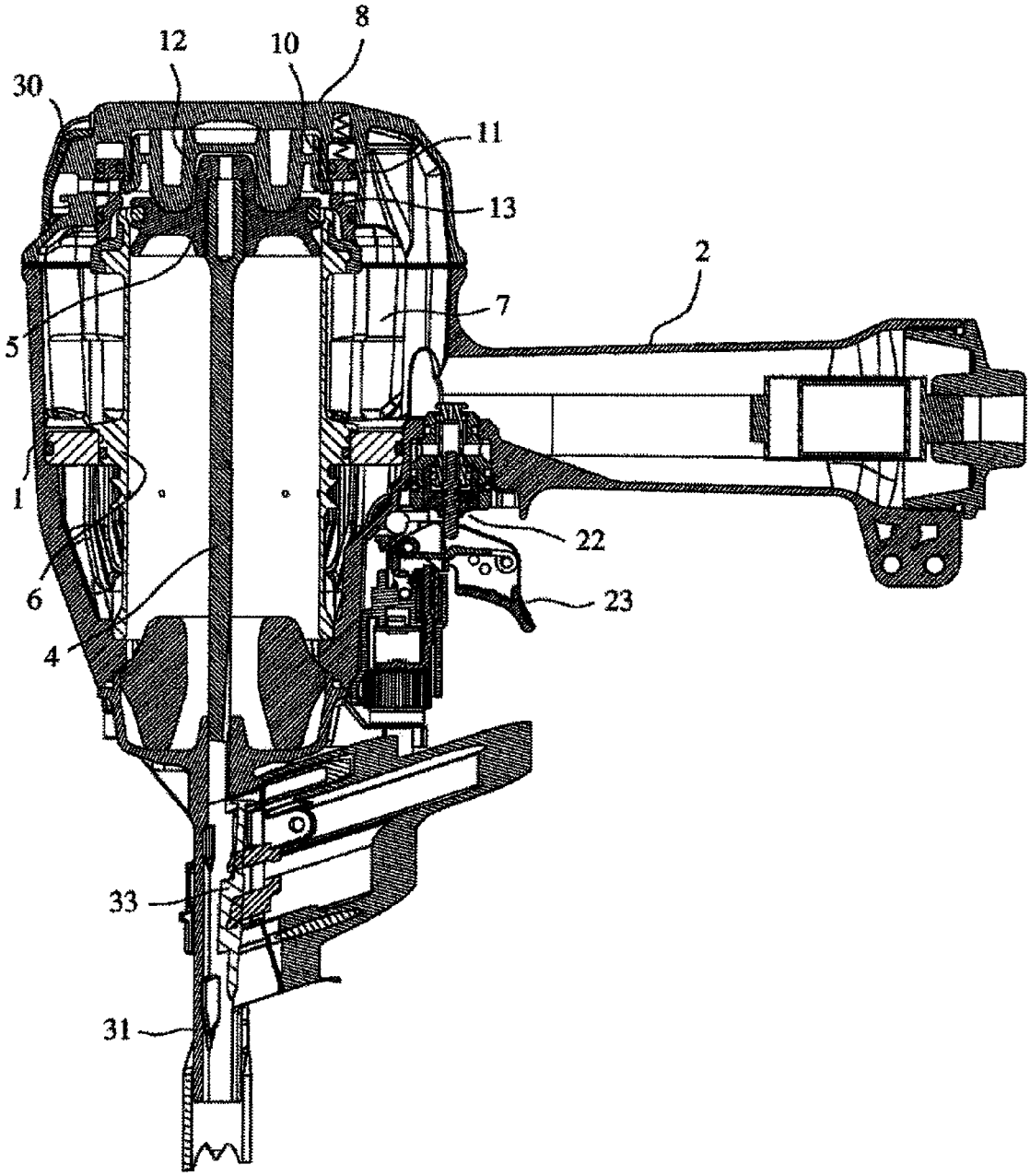
FIG. 1 is a longitudinal sectional diagram of the entirety of a nail driving machine according to a exemplary embodiment of the invention.

1 body
6 striking cylinder
7 main air chamber
8 cylinder cap
10 cylindrical inner wall
11 cylindrical outer wall
13 head valve

BEST MODE FOR CARRYING OUT THE INVENTION

Hereinafter, an exemplary embodiment of the invention will be explained with reference to drawings.

Figure 2:
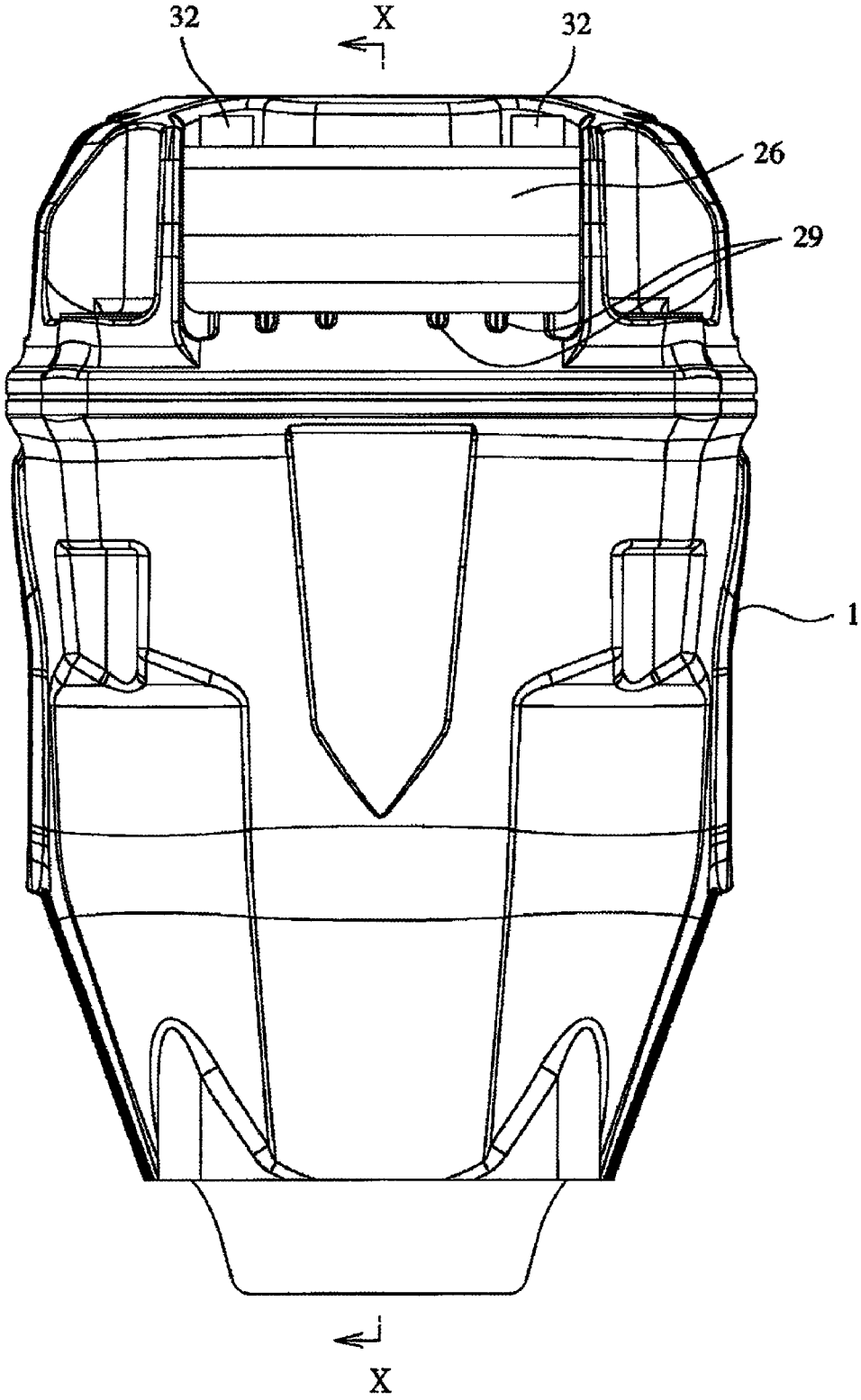
FIG. 2 is a font view of the entirety of the body of the nail driving machine.
Figure 3:
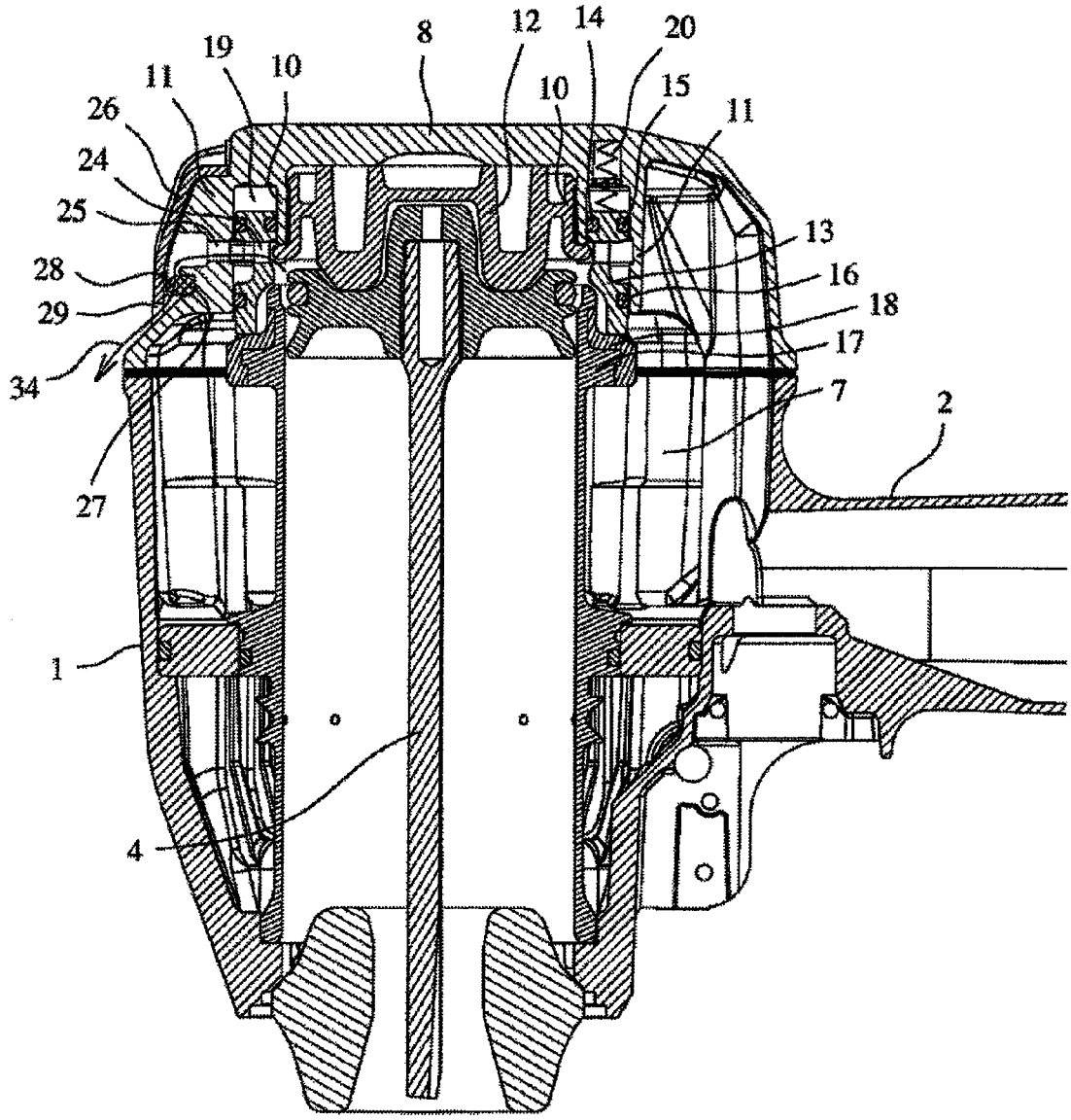
FIG. 3 is an enlarged sectional diagram of a part on a line X-X in FIG. 2.

In FIGS. 1 to 3, the reference numeral 1 denotes a body of a nail driving machine (driving tool). The body 1 is formed in a hollow shape and is provided at its one side with a hollow grip 2. Although not shown, an end portion of the grip 2 can be coupled to a compressed air supply source via an air hose. A nose portion 31 having a nail injection port is formed beneath the body 1.

A striking cylinder 6, for slidably accommodating a striking piston 5 connected with a nail driving driver 4, is disposed within the body 1. A main air chamber 7 for reserving compressed air therein is disposed at an outside of the striking cylinder 6. The main air chamber 7 communicates with the grip 2.

Next, a cylinder cap 8 for covering the cylinder and the main air chamber 7 is fixed at an upper portion of the body 1. A cylindrical inner wall 10 and a cylindrical outer wall 11 are integrally formed on a lower surface of the cylinder cap 8. A piston stop 12, which receives an upper surface of the striking piston 5 and defines a top dead center thereof, is provided at an inside of the cylindrical inner wall 10.

In contrast, an annular groove is formed between the cylindrical inner wall 10 and the cylindrical outer wall 11. A cylindrical head valve 13 is slidably housed within the annular groove. The head valve 13 opens and closes the main air chamber 7 and the striking cylinder 6. The head valve 13 is configured in a manner that upper and lower external diameters are formed to be the same. A lower portion of the head valve 13 is disposed at an outside of the striking cylinder 6. When the head valve 13 locates at the top dead center, the lower end of the head valve 13 is set to locate at substantially the same position with a lower end of the cylindrical outer wall 11. O-rings 14, 15 abutting in a sealed state to the cylindrical outer wall 11 are attached to inner and outer peripheries of the upper end portion of the head valve 13. An O-ring 16 abutting in a sealed state to the inner periphery of the cylindrical outer wall 11 is attached to the outer periphery of the lower portion thereof.

An annular projection portion 17 is formed at the outer periphery near the upper end of the striking cylinder 6. An elastic member 18 is provided around the outer periphery of the annular projection portion 17 and the upper end of the striking cylinder. The annular projection portion 17 is configured to receive, at the step portion thereof, the lower end of the head valve 13.

The head valve 13 is urged so as to normally move downward (in the closing direction) by a spring 20.

A head valve upper chamber 19 and a trigger valve 22 are coupled via a tube path (not shown) and the trigger valve 22 is operated and controlled by a trigger 23.

Next, exhaust ports 24, 25 are formed at the head valve 13 and the lower portion of the cylindrical outer wall 11 of the cylinder cap 8 so as to penetrate therethrough. An exhaust cover 26 is disposed at the outside of the exhaust port 24 of the cylinder cap 8. At the outside of the cylindrical outer wall 11 of the cylinder cap 8, a concave portion 27 is formed at the lower portion of the exhaust port 24. A filter 28 is housed and fixed in a space portion sandwiched between the concave portion 27 and the exhaust cover 26. An exhaust port 29 is formed at the lower portion of the exhaust cover 26. As shown in FIG. 2, the upper portion of the exhaust cover is fixed by two bolts 32 to a step portion 30 formed at the upper end edge of the cylinder cap 8.

Figure 4:
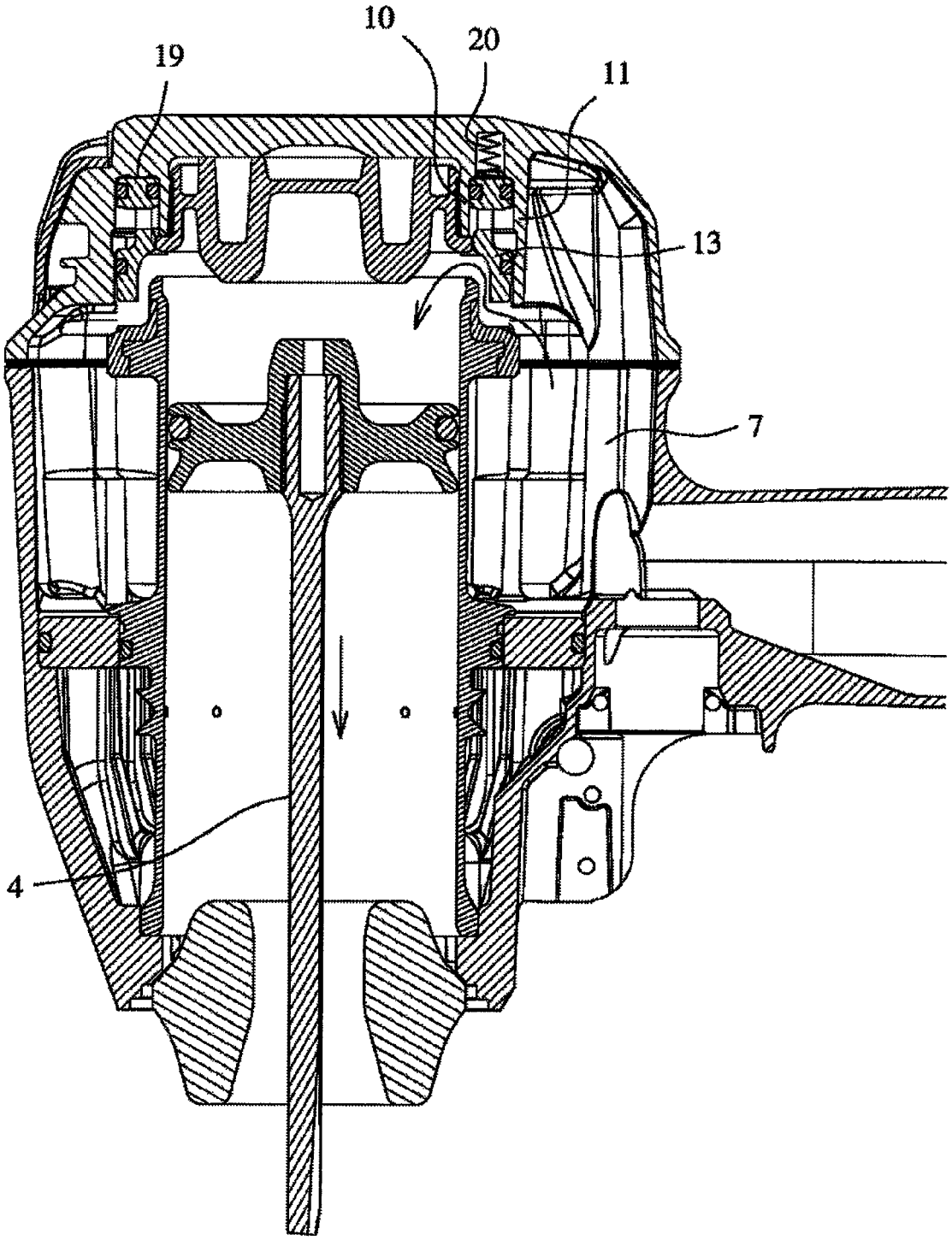
FIG. 4 is an enlarged sectional diagram in the case where a head valve operates.

According to the aforesaid configuration, in the case where the trigger 23 is pulled to operate the trigger valve 22, the compressed air within the main air chamber 7 is exhausted when the head valve 13 within the head valve upper chamber 19 is opened. Thus, a pressure difference appears between the upper surface and the lower surface of the head valve 13, and so as shown in FIG. 4, the head valve 13 opens above against the spring 20. The compressed air within the main air chamber 7 is supplied within the striking cylinder 6 to drive the striking piston 5 and the driver 4 downward, whereby the driver 4 drives a nail 33 (see FIG. 1) supplied within the nose portion 31.

Next, when a force having been applied to the trigger 23 is released after the driving operation, the trigger valve 22 operates and the compressed air within the main air chamber 7 is supplied to the head valve upper chamber 19. Thus, since the pressure difference between the upper surface and the lower surface of the head valve 13 becomes zero, the head valve 13 closes by the force of the spring 20 as shown in FIG. 2. When the head valve 13 closes, as shown in FIG. 3, the exhaust port 25 of the cylinder cap 8 communicates with the upper portion of the striking cylinder 6 via the exhaust port 24 of the head valve 13, and further an exhaust path 34 communicating with the exhaust port 29 formed at the lower portion of the exhaust cover 26 is formed. Thus, the compressed air within the striking cylinder 6 is exhausted from the exhaust port 29 via the exhaust path 34 and the filter 28 disposed beneath the exhaust path. Simultaneously, the striking piston 5 moves upward again and restores.

As described above, since the head valve 13 is configured in a manner that the upper and lower external diameters thereof are formed to be the same, each of the cylindrical inner wall 10 and the cylindrical outer wall 11 for housing the head valve 13 therein and guiding the head valve so as to move elevationally can be configured in a cylindrical shape having the same diameter. Thus, the cylindrical inner wall 10 and the cylindrical outer wall 11 can be easily formed integrally at the cylinder cap 8. Therefore, since it becomes unnecessary to use a part such as the head valve guide of the related art, the number of parts can be reduced and the lowering of the entire-height can be realized and further the cost can be reduced.

Further, after the completion of the driving operation, the compressed air within the striking cylinder 6 is exhausted form the exhaust port 25 at the side portion of the cylinder cap 8. Thus, the entire height can be made lower.

Furthermore, since the machine is configured to exhaust from the exhaust port 29 formed at the lower portion of the exhaust cover 26 via the filter 28, the filter 28 can be disposed and fixed between the concave portion 27 of the side wall (cylindrical outer wall 11) of the cylinder cap 8 and the exhaust cover 26. Thus, only the exhaust cover 26 is required to be fixed to the cylinder cap 8 by means of the two bolts 32. Conventionally, since the machine is configured in a manner that the filter is fixed to the rear surface of the exhaust cover, four bolts are required. Thus, the number of the bolts can be reduced.

The low entire-height structure is not limited to be applied to the nail driving machine and may be applied to a driving tool such as a screw driving machine in which compressed air is used as a driving source.

Although the invention has been explained in detail with reference to the particular embodiment, it would be apparent for those skilled in the art that various modifications and changes may be made without departing from sprits and scopes of the invention.

The present application is based on Japanese Patent Application (Patent Application. No. 2005-210495) filed on Jul. 20, 2005, the contents of which is incorporated herein by reference.

INDUSTRIAL APPLICABILITY

The invention can be applicable for a low entire-height structure of a driving tool which can lower an entire height.

The invention claimed is:

1. A driving tool comprising:

a hollow body;

a striking cylinder disposed in the body;

a striking piston slidably accommodated in the striking cylinder;

a main air chamber disposed outside of the striking cylinder for reserving compressed air;

a cylinder cap fixed on an upper portion of the body covering the striking cylinder and the main air chamber;

a head valve which opens and closes the main air chamber and the striking cylinder, wherein a lower portion of the head valve is disposed outside of the striking cylinder;

a cylindrical inner wall and a cylindrical outer wall which are provided at a lower surface of the cylinder cap and are integrally formed with the cylinder cap;

a piston stop which is provided inside of the cylindrical inner wall and defines a top dead center of the striking piston;

an exhaust port penetrating through a lower portion of a side wall of the cylinder cap; and an exhaust port penetrating the head valve, wherein the head valve is slidably disposed between the cylindrical inner wall and the cylindrical outer wall, and when the head valve closes, the exhaust port of the cylinder cap is connected with an upper portion of the striking cylinder via the exhaust port of the head valve.

2. The driving tool according to claim 1, wherein the head valve is formed in a cylindrical shape having the same upper and lower external diameters.

3. The driving tool according to claim 1, further comprising:

an exhaust cover disposed at outside of the exhaust port of the cylinder cap;

an exhaust port formed at a lower portion of the exhaust cover; and a filter, wherein exhaust gas is exhausted via the filter.

* * * * *